US005687793A

United States Patent [19]

Reimert et al.

[11] Patent Number: 5,687,793

[45] Date of Patent: Nov. 18, 1997

[54] APPARATUS FOR USE IN LOWERING A WELL PIPE INTO ALIGNMENT WITH A SUBSEA CONDUIT

[75] Inventors: Larry E. Reimert, Spring; Bruce J. Watkins, Houston, both of Tex.

[73] Assignee: Dril-Quip, Inc., Houston, Tex.

[21] Appl. No.: 616,677

[22] Filed: Mar. 15, 1996

[51] Int. Cl.[6] ..... E21B 33/038

[52] U.S. Cl. ..... 166/342; 166/349; 166/359; 285/18; 405/170

[58] Field of Search ..... 166/341, 342, 166/344, 348, 349, 351, 359, 367, 368; 405/169, 170; 285/18, 24

[56] References Cited

U.S. PATENT DOCUMENTS

| | | | |
|---|---|---|---|
| 3,096,999 | 7/1963 | Ahlstone et al. | 166/341 X |
| 3,601,188 | 8/1971 | McGlamery et al. | 166/359 X |
| 3,971,171 | 7/1976 | Wood | 166/351 X |
| 4,405,263 | 9/1983 | Hall | 166/342 X |
| 4,478,287 | 10/1984 | Hynes et al. | 166/341 |
| 4,609,046 | 9/1986 | Schawann et al. | 166/341 |
| 4,706,757 | 11/1987 | Harrington | 166/349 |
| 4,797,029 | 1/1989 | Cowan et al. | 166/341 |
| 5,158,141 | 10/1992 | Saliger et al. | 166/341 |

*Primary Examiner*—George A. Suchfield

*Attorney, Agent, or Firm*—Vaden, Eickenroht & Thompson, LLY

[57] ABSTRACT

Apparatus is disclosed for use in lowering an object such as a well pipe through a guide tube suspended from the water surface and onto an upstanding subsea conduit beneath the lower end of the guide tube.

19 Claims, 3 Drawing Sheets

APPARATUS FOR USE IN LOWERING A WELL PIPE INTO ALIGNMENT WITH A SUBSEA CONDUIT

FIELD OF THE INVENTION

This invention relates to apparatus for use in lowering an object such as a well pipe onto an upstanding subsea structure such as a subsea conduit with which the well pipe is to be aligned. In one aspect of the invention, it relates to such apparatus in which the well pipe, which may be a riser pipe, is to be connected to the upper end of a subsea wellhead to permit various pipe strings or other objects to be lowered into and raised from the well beneath the wellhead, for example, during drilling and/or completion of a subsea well. More particularly, the invention relates to improvements in apparatus of this type in which the well pipe is adapted to be so lowered through a guide tube suspended from the water surface with its lower end generally above the upper end of the conduit.

Inasmuch as it is normally suspended from a platform which may be a considerable distance above the ocean floor, the lower end of the guide tube is only generally aligned with the wellhead, thus requiring the use of ROVs or other remotely operated equipment for bringing a connector on the lower end of the riser into a position for alignment with the wellhead after it has been lowered beneath the lower end of the guide tube. Although it would therefore be desirable to guide the lower end of the connector over the upper end of the wellhead by means of a conventional cone at its lower end, this would require a guide pipe of much larger diameter then the connector at the lower end of the riser pipe.

SUMMARY OF THE INVENTION

An object of this invention is to provide apparatus of this type for guiding the lower end of the riser pipe, or other well pipe, into alignment with the upper end of the wellhead, or other subsea conduit, without the use of ROVs or other auxiliary equipment at the ocean floor and/or without increasing the diameter of the guide tube substantially beyond that necessary to pass the connector.

Another object is to provide apparatus of the type above described which, upon lowering the riser pipe or other conduit onto the wellhead or other subsea conduit, includes parts which may be easily and quickly removed therefrom and recovered for use in lowering other such pipe at the same or other well installations.

These and other objects are accomplished, in accordance with the illustrated and described embodiment of the present invention by apparatus which comprises a carrier adapted to be supported from the lower end of the object for lowering closely within the guide tube, and means on the lower end of the carrier which is expandable outwardly to form a downwardly and outwardly extending shroud, as the lower end of the carrier emerges from the lower end of the guide tube, which is adapted to fit over the upper end of the subsea structure and thus guide the lower end of the object onto the upper end of the structure as the carrier continues to be lowered. As illustrated, the shroud comprises arms pivotally connected to the lower end of the carrier for swinging about generally horizontal axes between inner positions in which they are within the guide tube and outer positions in which they are flared outwardly therefrom, and means for moving the arms from their inner to their outer positions when they are beneath the lower end of the guide tube. More particularly, the means for moving the arms comprises rods supported by the carrier for guided vertical movement with respect thereto between upper and lower positions, and means connecting the lower end of each rod to the upper end of an arm so as to move the arms from their inner to their outer positions in response to movement of the rods from one position to the other. As illustrated, this comprises a ring connected to the upper ends of the rods, and reciprocal operators on the carrier each connected to the ring so as to move the rods in response to actuation of the operators.

Preferably, the connection of the rods to the arms comprises a link having an upper end pivotally connected to the lower end of each rod and a lower end guidably movable within the carrier and pivotally connected to each arm for vertical movement between positions above and below the connection to the rod, as the lower end of the link emerges from the lower end of the guide tube, thus acting as a crank to swing the arms inwardly and outwardly.

The object may be a well pipe, and the subsea structure an upstanding well conduit with which the well pipe is to be aligned. In the preferred embodiment of the invention the carrier includes a carrier including a tubular body adapted to be supported from the lower end of the well pipe, and a generally cylindrical housing supported from and about the body for lowering closely within the guide tube. More particularly, the arms which form the shroud are pivotally connected to the lower end of the housing, the rods are supported by the body for guided vertical movement with respect thereto, and the reciprocable actuators are mounted on the housing.

In accordance with another novel aspect of the invention, the housing has a side opening extending upwardly from its lower end and a door hingedly connected to the side of the opening so that, when the door is open, the housing may be removed laterally when its lower end of the well pipe is over the subsea structure.

As illustrated, the well pipe is a riser pipe through which various well tools and/or other parts may be lowered during drilling and/or completion of a subsea well, the subsea conduit comprises a wellhead having means to which the housing is to be connected in order to install the riser pipe in axial alignment with the bore of the wellhead, and the body on the lower end of the well pipe has a connector at its lower end to permit it to be connected to the wellhead when lowered into alignment therewith.

BRIEF DESCRIPTION OF THE DRAWINGS

In the drawings, wherein like reference characters used throughout to designate like parts.

DESCRIPTION OF THE PREFERRED EMBODIMENT

Figure 3:
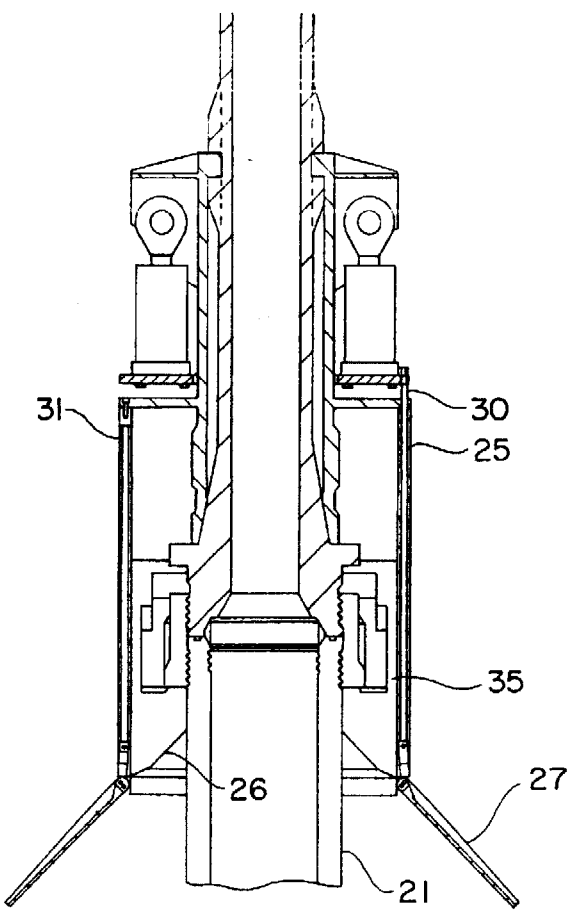
FIG. 3 is a view similar to FIG. 2, but upon further lowering of the apparatus so as to permit its shroud to guide the connector onto and into alignment with the bore through the wellhead, and upon actuation of the connector into connection with the upper end of the wellhead.
Figure 2:
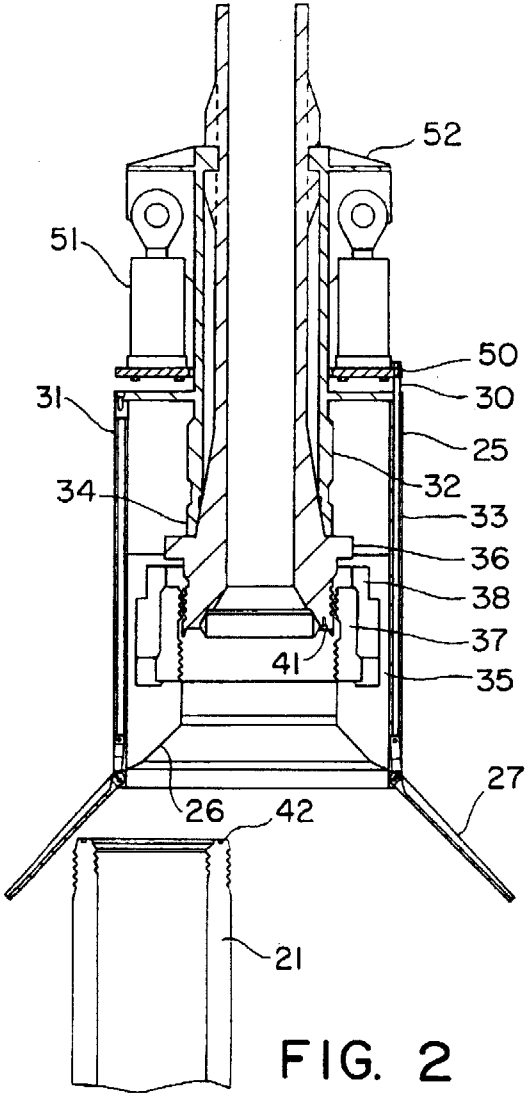
FIG. 2 is a vertical sectional view of the apparatus upon lowering through the guide tube into a position generally above the upper end of a subsea wellhead, and with the arms swung outwardly to a position forming a shroud for guiding a connector into alignment wellhead.
Figure 1:
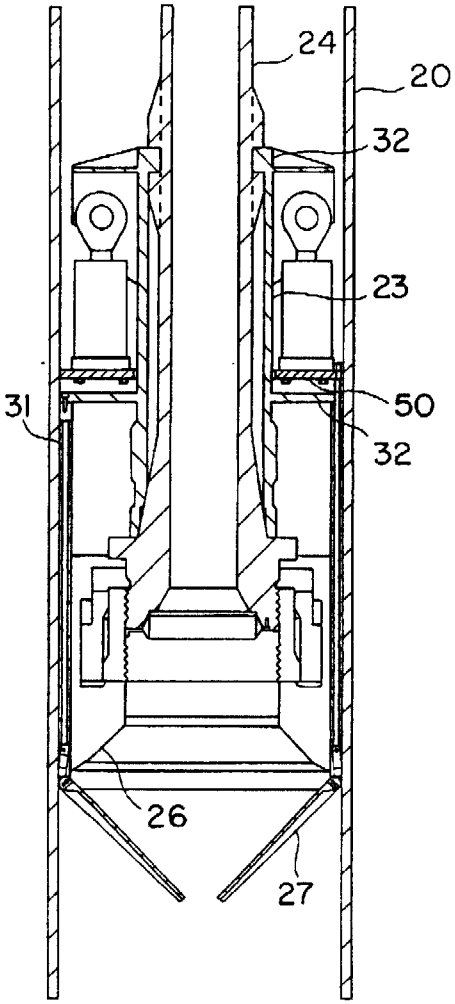
FIG. 1 is a vertical sectional view of apparatus constructed in accordance with the present invention as it is lowered through a guide tube with its arms swung inwardly.
Figure 5B:
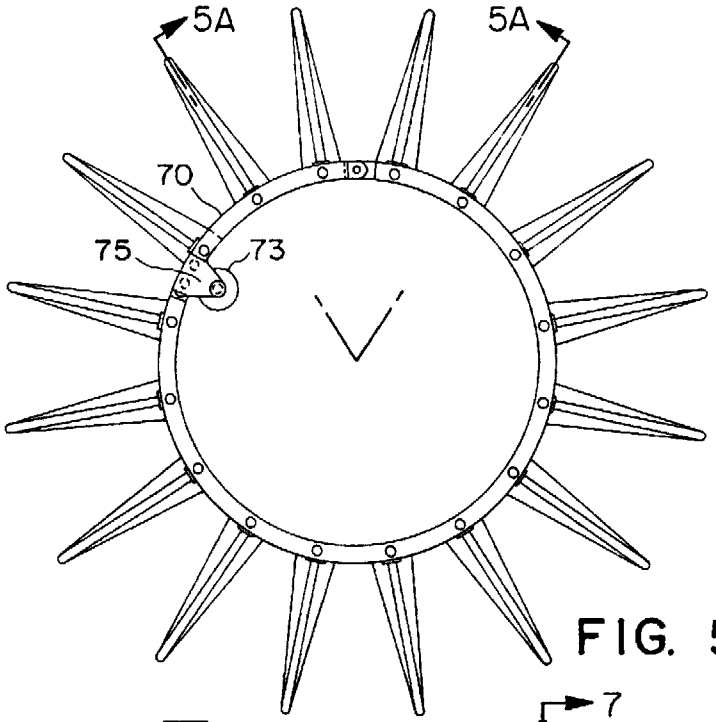
FIG. 5B is a top plan view of the housing and arms of FIG. 5A, similar to FIG. 4B, but with the door closed.
Figure 5A:
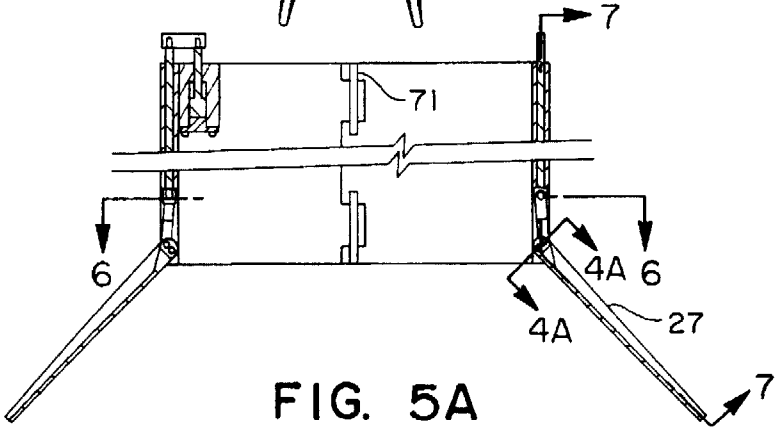
FIG. 5A is a vertical sectional view of the housing, similar to FIG. 4A, but with the arms swung outwardly to their shroud forming positions, as shown in FIGS. 2 and 3.

With reference now to the details of the above described drawings, the guide tube shown in FIG. 1, and indicated in its entirety by reference character 20, is, as previously described, suspended from a platform at the surface of the water generally above a wellhead whose upper end is indicated at 21 in each of the FIGS. 2 and 3. Although not shown, the lower end of the guide tube may be a substantial distance above the upper end of the wellhead, and thus out of alignment with the upper end of the wellhead. As previously described, the lower end of a well pipe, and as illustrated, a riser pipe, is adapted to be lowered through the guide tube 20 and onto and into alignment with the bore through the wellhead 21.

In accordance with the illustrated embodiment of the present invention, the apparatus for guidably lowering the lower end of the riser pipe comprises a carrier 23 including a tubular body 24 having means (not shown) at its upper end for connection to the lower end of the riser pipe, and a housing 25 carried by and disposed about the lower end of the tubular body. As shown, a connector 26 is mounted on the lower end of the body and closely within the lower end of the housing 25 in position to connect the lower end of the body, and thus the riser pipe, in axial alignment with the subsea wellhead 21.

More particularly, a series of circumferentially spaced apart arms 27 are pivotally mounted on the lower end of the housing, for swinging about horizontal axes between the inwardly extending positions of FIG. 1 and the outwardly extending positions of FIGS. 2 and 3. In their inner positions, the arms are disposed beneath the lower end of the connector, and thus within the guide tube so as to permit the housing, which fits closely within the guide tube, to move easily therethrough. In their outer position, however, the arms form a downwardly and outwardly extending shroud. In a manner to be described in detail to follow, the arms are swung outwardly when the lower end of the housing has been lowered to a position beneath the lower end of the guide tube, so that, upon further lowering of the carrier with the riser pipe from the position of FIG. 2 to the position of FIG. 3, the lower end of the connector is guided laterally into a position in which its lower end is over and aligned with the upper end of the wellhead, so as to permit the connector 26 to be connected to the wellhead.

As previously described, a plurality of circumferentially spaced rods 30 are vertically slidable within holes 31 in the housing and pivotally connected at lower ends to the upper ends of an arms for moving the arms between inner and outer positions. The housing includes an inner tubular member 32 having an upper end releasable connected to the tubular body 24 so as to be carried thereby as well as an intermediate flange connecting the inner tubular member to an outer tubular member 33 which fits closely within the guide tube 20. As shown, the rods 30 are received in the vertical holes 31 through the outer member, and lower end of the inner tubular member has an inner conical surface which fits closely about an outer conical surface 34 on the lower end of the tubular body 24 so that the tubular body and housing are maintained in co-axial relation.

The connector 26 includes a body 35 mounted on and carried from a flange 36 near the lower end of the tubular body, and a split locking ring 37 supported in circumferentially spaced relation with a recess in the body to permit it to be moved between a normally assumed outer position (FIG. 2) and an inner locking position (FIG. 3) by means of a vertically reciprocating operator 38. In its outer position, the locking ring of the connector moves downwardly over the upper end the wellhead 21, and then, upon landing of the lower end 41 of the tubular body on the upper end 42 of the wellhead, moved inwardly to locking position, as shown in FIG. 3, in which teeth about its inner side engage oppositely facing grooves about the lower end of body 24 and upper end of the wellhead. Obviously, upon shifting of the operator to its upper position, the locking ring may expand outwardly to disconnect from the subsea wellhead, and thus permit the carrier and riser pipe to be lifted therefrom. As shown, the lower end of the connector body is conically shaped to form a continuation of the shroud formed by the arms as the carrier is lowered onto the wellhead.

The upper ends of the rods 30 are connected to a ring 50 which is raised and lowered by means of spaced-apart fluid actuators 51 connected at opposite ends to the ring and a flange 52 which extends radially outwardly from the upper tubular member of the housing. Thus, upon operation of the actuators, the rods are reciprocated between lower positions, as shown in FIG. 1, wherein the arms 27 are moved inwardly to their inner positions, and upper positions, as shown in FIGS. 2 and 3, wherein the arms are moved outwardly to form the shroud.

For this purpose, the lower end of each rod is connected to the upper end of an arm by means of a link 53 pivotally connected by a pin 54 at its upper end to the lower end of rod and at its lower end to the upper end of the arm by a pin 55. The upper end of the arm is pivotally connected to the housing by a pin 55A, and each link and the upper end of the rod are received within a slot 56 extending upwardly from the lower edge of the housing.

As shown in FIGS. 7 and 8A–8C, each link is assembled in a cartridge 53A for mounting in the slot 56 of the housing. A pin 55 extends through aligned holes in the cartridge and arm, and pins 55A extend through aligned hole in the arm and slot. More particularly, the pins 55 and 55A are laterally spaced from one another so that, upon raising of the rods, the pins 55A are caused to swing in a counterclockwise direction, and thus from a position beneath to a position above the pin 55, in order to swing the arm in the same direction from its inner to its outer position.

As also shown in FIGS. 7 and 8A–8C, a nut 60 is threadedly connected to the lower end of each pin and received within a slot 61 formed within the upper end of the link. Pin 54 is received through a hole in the nut and aligned holes in the cartridge on the opposite sides of the nut and has its opposite ends within guideways 61 in opposite sides of the slot 56 in the housing. The upper and lower ends of the link are so spaced from the ends of the recess and slot as to permit the link to move vertically with the rod to which it is connected and moving the arms between their inner and outer positions.

Figure 4B:
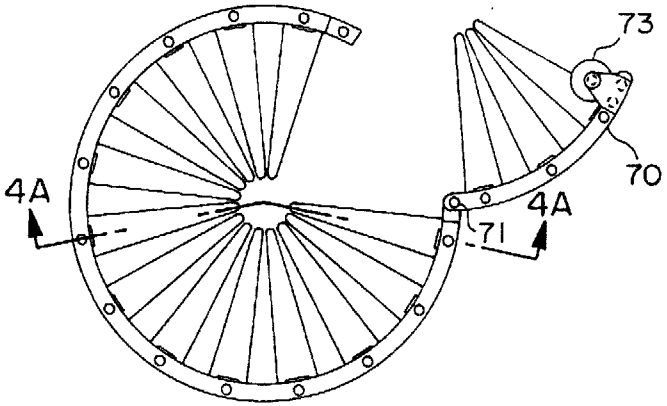
FIG. 4B is a top plan view of the housing and its arms, as shown in FIG. 4A, and with a door in the side of the housing shown in broken lines swung outwardly to its open position.
Figure 4A:
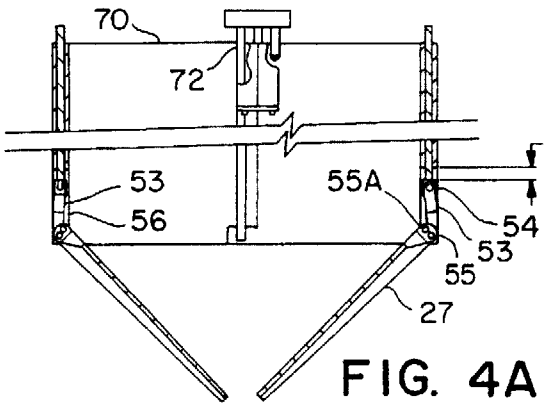
FIG. 4A is a vertical sectional view of the housing and the arms at its lower end, on an enlarged scale, with the arms swung to their inner positions, as shown in FIG. 1.
Figure 8C:
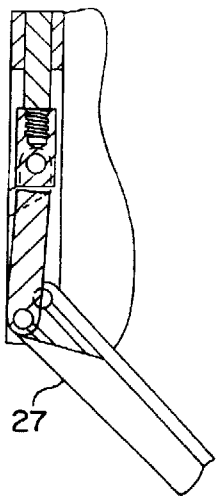
FIGS. 8B and 8C are sectional views of the connection between the lower end of the rod and upper end of each arm, as seen along broken lines 8B/8C of FIG. 8A, with the arm shown respectively in its outer and inner positions.
Figure 8B:
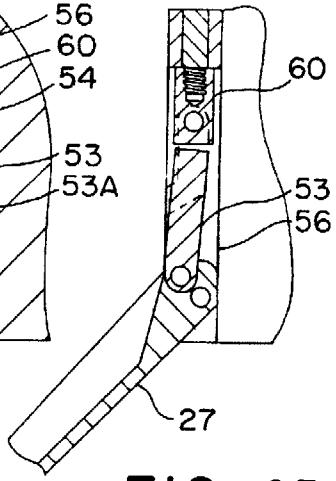
Figure 8A:
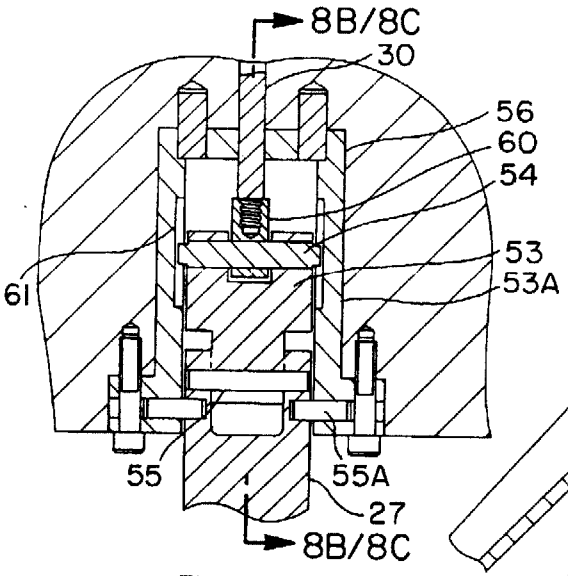
FIG. 8A is a further enlarged detailed sectional view of the connection between the lower end of the rod and the upper end of each arm, as seen in FIG. 7.
Figure 9:
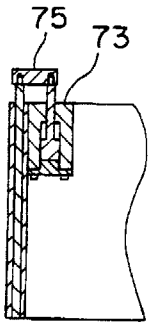
FIG. 9 is a vertical sectional detailed view of a portion of the housing and illustrating a locking pin for the door and as operator mounted on the housing for moving the locking pin between locking and unlocking positions.
Figure 7:
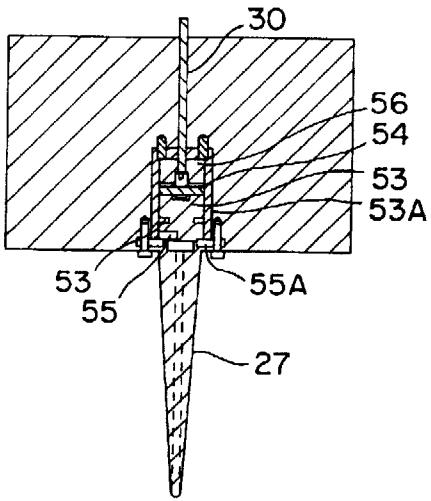
FIG. 7 is an enlarged vertical sectional view of a portion of the housing, as seen along broken lines 7—7 of FIG. 5A.
Figure 6:
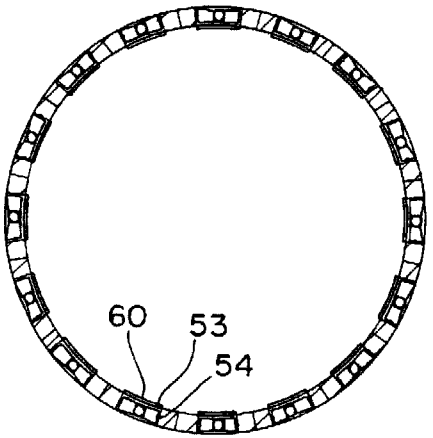
FIG. 6 is a cross sectional view of the housing, as seen along broken lines 6—6 of FIG. 5A.

As also previously described, a door 70 is disposed within an opening extending upwardly from the bottom edge of the housing so that, when the door is in an open position, as seen in FIG. 4B, the housing including the parts mounted thereon may be moved laterally off of the tubular body and connector which remains connected to the wellhead, thus permitting the housing portion of the carrier to be used at another location. For this purpose, one side edge of the door is connected to an adjacent side of the opening in the housing by means of a hinge pin 71 and the other side edge thereof is releasably locked to the adjacent edge which extends vertically a short section of the housing opening, so that the door may be released swung to the open position with a minimum of lift of the hinge pin. This movement is provided by a reciprocal actuator 73 mounted on the upper edge of the door by a flange 75, as shown in FIG. 9, and connected at the upper end to a plate to which the lock pin is connected.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for use in lowering an object through a guide tube suspended from the water surface onto the upper end of an upstanding subsea structure located generally beneath the lower end of the guide tube, comprising:

a carrier adapted to be supported from the lower end of the object for lowering closely within the guide tube, and means on the lower end of the carrier which is expandable outwardly to form a downwardly and outwardly extending shroud, after the lower end of the carrier emerges from the lower end of the guide tube, which is adapted to fit over the upper end of the subsea structure and thus guide the lower end of the object onto the upper end of the structure as the carrier continues to be lowered, wherein said shroud comprising:

arms pivotally connected to the lower end of the carrier for swinging about generally horizontal axis between inner positions in which they are within the guide tube and outer positions in which they are flared outwardly therefrom, and means for moving the arms from their inner to their outer positions when they are beneath the lower end of the guide tube, wherein the moving means comprises:

rods supported by the carrier for guided vertical movement with respect thereto between upper and lower positions, and means connecting the lower end of each rod to the upper end of an arm so as to move the arms from their inner to their outer positions in response to movement of the rods from one position to the other.

2. As in claim 1, wherein said connecting means comprises a link having an upper end pivotally connected to the lower end of each rod and a lower end guidably movable within the carrier and pivotally connected to each arm for vertical movement between positions above and below the connection to the rod after the lower end of the link emerges from the lower end of the guide tube.

3. As in claim 2, including means on the carrier connected to the upper ends of the rods for moving them between their upper and lower position.

4. As in claim 3, wherein said moving means comprises a ring connected to the upper ends of the rods, and reciprocal operators on the carrier each connected to the ring so as to move the rods in response to actuation of the operators.

5. Apparatus for use in lowering a well pipe through a guide tube suspended from the water surface onto and into alignment with the upper end of an upstanding subsea conduit located generally beneath the lower end of the guide tube, comprising a carrier including a tubular body adapted to be supported from the lower end of the well pipe, and a generally cylindrical housing supported from and about the body for lowering closely within the guide tube, means on the lower end of the housing which is expandable outwardly to form a downwardly and outwardly extending shroud to fit over the upper end of the subsea conduit and thus axially align the lower end of the well pipe with the upper end of the conduit as the housing continues to be lowered, and means on the body for so expanding the shroud forming means after the lower end of the housing emerges from the lower end of the guide tube.

6. As in claim 5, wherein the shroud comprises arms pivotally connected to the lower end of the housing for swinging about generally horizontal axis between inner positions in which they are within the guide tube and outer positions in which they are flared outwardly therefrom, and means on the body connected to the upper ends of the arms for moving the arms from their inner to their outer positions when they are beneath the lower end of the guide tube.

7. As in claim 6, wherein the moving means comprises rods carried by the body for guided vertical movement with respect to the housing between upper and lower positions, and means connecting the lower end of each rod to the upper end of an arm so as to move the arms from their inner to their outer positions in response to movement of the rods from one position to the other.

8. As in claim 7, wherein said connecting means comprises a link having an upper end pivotally connected to the lower end of each rod and a lower end guidably movable within the housing and pivotally connected to each arm for vertical movement between positions above and below the connection to the rod after the end of the link is lowered beneath the lower end of the guide tube.

9. As in claim 8, including means on the body connected to the upper ends of the rods for moving them between their upper and lower position.

10. As in claim 9, wherein said moving means comprises a ring connected to the upper ends of the rods, and reciprocal operators on the body each connected to the ring so as to move the rods in response to actuation of the operators.

11. As in claim 5, wherein the housing has a side opening extending upwardly from its lower end and a door hingedly connected to the side of the opening so that, when the door is open, the housing may be moved laterally off of the body when its lower end of the well pipe is over the subsea structure.

12. Apparatus for use in lowering a well pipe through a guide tube suspended from the surface into connection with an upstanding wellhead generally beneath the lower end of the guide tube, comprising a carrier including a tubular body adapted to be supported from the lower end of the well pipe and having a connector at its lower end, and a generally cylindrical housing supported from the body in surrounding relation to the connector for guidably lowering through the guide tube, means carried on the lower end of the housing which is expandable outwardly to form a downwardly and outwardly extending shroud which is adapted to fit over the upper end of the conduit and thus align the connector with the upper end of the conduit as the connector continues to be lowered through the housing to a position in which the connector may be connected to the conduit, and means on the body for so expanding the shroud forming means after the housing emerges from the lower end of the guide tube.

13. As in claim 12, wherein the wellhead has locking grooves about its upper end, and the connector has teeth for engaging the grooves.

14. As in claim 12, wherein the shroud comprises arms pivotally connected to the lower end of the housing for swinging about generally horizontal axis between inner positions in which they are within the guide tube and outer positions in which they are flared outwardly therefrom, and means on the body connected to the upper ends of the arms for moving the arms from their inner to their outer positions when they are beneath the lower end of the guide tube.

15. As in claim 14, wherein the moving means comprises rods carried by the body for guided vertical movement with respect to the housing between upper and lower positions, and means connecting the lower end of each rod to the upper end of an arm so as to move the arms from their inner to their outer positions in response to movement of the rods from one position to the other.

16. As in claim 15, wherein said connecting means comprises a link having an upper end pivotally connected to the lower end of each rod and a lower end guidably movable within the housing and pivotally connected to each arm for vertical movement between positions above and below the connection to the rod after the end of the link is lowered beneath the lower end of the guide tube.

17. As in claim 16, including means on the body connected to the upper ends of the rods for moving them between their upper and lower position.

18. As in claim 17, wherein said moving means comprises a ring connected to the upper ends of the rods, and reciprocal operators on the body each connected to the ring so as to move the rods in response to actuation of the operators.

19. As in claim 12, wherein the housing has a side opening extending upwardly from its lower end and a door hingedly connected to the side of the opening so that, when the door is open, the housing may be moved laterally off of the body when its lower end of the well pipe is over the subsea structure.

* * * * *

UNITED STATES PATENT AND TRADEMARK OFFICE

CERTIFICATE OF CORRECTION

PATENT NO. : 5,687,793

DATED : November 18, 1997

INVENTOR(S) : Larry E. Reimert, Bruce J. Watkins

It is certified that error appears in the above-indentified patent and that said Letters Patent is hereby corrected as shown below:

Col. 2, line 20, after "includes" cancel --a carrier including--.
Col. 2, line 56, after "alignment" insert --with the--.
Col. 3, line 19, change "as" to --an--.
Col. 4, line 4, change "arms" (first Occurrence) to --arm --.
Col. 4, line 6, change "releasable" to --releasably--.
Col. 5, line 21, after "released" and before "swung" insert --and--.

Signed and Sealed this

Thirtieth Day of June, 1998

*Attest:*

Bruce Lehman

BRUCE LEHMAN

*Attesting Officer*

*Commissioner of Patents and Trademarks*